United States Patent [19]

Weimer

[11] Patent Number: 4,770,339

[45] Date of Patent: Sep. 13, 1988

[54] VENTILATED, STACKABLE GRAPE BOX

[75] Inventor: Charles P. Weimer, Putnam, Conn.

[73] Assignee: International Paper Company, Purchase, N.Y.

[21] Appl. No.: 46,488

[22] Filed: May 6, 1987

[51] Int. Cl.[4] ..... B65D 5/22

[52] U.S. Cl. ..... 229/143; 229/120; 229/150; 229/174; 229/177; 229/178; 229/918; 229/DIG. 11

[58] Field of Search ..... 229/120, 143, 149, 150, 229/174, 177, 178, 179, 191, 918, DIG. 11

[56] References Cited

U.S. PATENT DOCUMENTS

| | | | |
|---|---|---|---|
| 3,343,744 | 9/1967 | Morell et al. | 229/149 |
| 3,973,723 | 8/1976 | Owens | 229/143 |
| 4,056,223 | 11/1977 | Williams | 229/918 |
| 4,129,247 | 12/1978 | McCall | 229/178 |

FOREIGN PATENT DOCUMENTS

| | | | |
|---|---|---|---|
| 1289639 | 2/1962 | France | 229/DIG. 11 |
| 1383824 | 11/1964 | France | 229/178 |
| 2329523 | 3/1977 | France | 229/DIG. 11 |
| 2424192 | 11/1979 | France | 229/149 |
| 556550 | 2/1957 | Italy | 229/DIG. 11 |
| 368091 | 4/1963 | Switzerland | 229/178 |
| 1290267 | 9/1972 | United Kingdom | 229/178 |

*Primary Examiner*—Stephen Marcus
*Assistant Examiner*—Gary E. Elkins
*Attorney, Agent, or Firm*—Walt Thomas Zielinski

[57] ABSTRACT

A ventilated grape box and a one-piece blank for forming it. The blank is formed from corrugated paperboard and is cut and scored to permit it to be folded into a stackable grape box without the need for fasteners. The upper edges of both ends of the box are provided with upstanding stacking tabs which are adapted to fit in complementary recesses in the lower edges of an identical box stacked above it. Each of two upper closure panels is provided with tabs which frictionally engage certain end panels to thereby maintain the upper closure panels closed after the box is filled with grapes. Certain end forming panels are folded to define a triangular column at each inside corner of the box, to thereby increase stacking strength.

3 Claims, 4 Drawing Sheets

VENTILATED, STACKABLE GRAPE BOX

BACKGROUND OF THE INVENTION

This invention relates to containers and more particularly to a ventilated grape box formed from corrugated paperboard or other stiff, resilient and bendable sheet material.

This art is already aware of a variety of constructions of corrugated paperboard boxes fashioned from a one-piece blank, the blank being suitably cut and provided with score lines, so that the blank can be folded to form a complete box without the use of staples, stitches, adhesives, or the like. The prior art is also aware of boxes of this general type which are vertically stackable, and which carry upstanding alignment elements adapted to fit into corresponding receiving apertures in a box stacked directly over it. One problem with prior art constructions is that such boxes sometimes require fastening elements or an adhesive for their formation and, further, display alignment elements for the stacking purpose which are not as strong as desirable. Further, the top closure panels of many prior art constructions suffer the drawback of being relatively easily dislodged from their desired, closed position.

SUMMARY OF THE INVENTION

According to the practice of this invention, a one-piece blank of corrugated paperboard is cut and scored and is folded to produce a ventilated box particularly suitable for the packaging and shipment of grapes. The several panels which form the box are provided with apertures to provide ventilation. No separate fastening elements or other fastening means such as adhesive is required. Further, the top closure panels of the box exhibit added resistance to dislodgement from their desired, horizontal and locked or closed position. Still further, the grape box of this invention is provided with stacking tabs, with each stacking tab being of a double thickness construction to thereby add increased strength to them. Still further, each of the four interior corners of the box is provided with a stacking post of generally triangular configuration, these stacking posts adding vertical strength to the box to thereby increase stacking strength or stacking capacity.

DETAILED DESCRIPTION OF THE INVENTION

Figure 1:
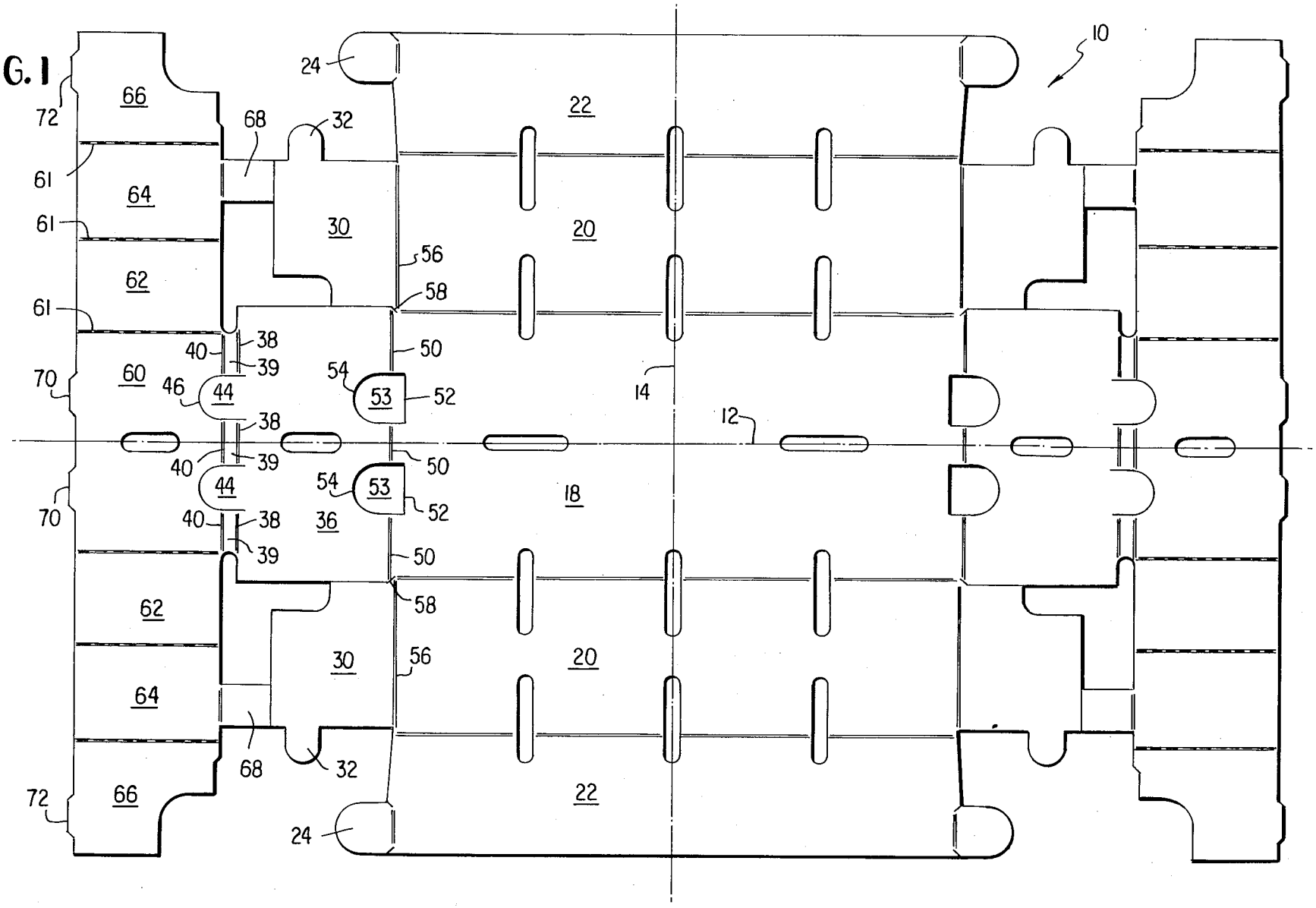
FIG. 1 is a plan view showing a one-piece blank, typically of corrugated paperboard, from which the box of this construction is formed.

Referring now to FIG. 1, the numeral 10 denotes generally the one-piece blank of corrugated paperboard from which the box of this invention is fashioned. The blank is generally rectangular in shape, and has a longitudinal axis 12 and a transverse axis 14. The blank is cut and scored as indicated, with the double lines indicating score or bend or fold lines, and the solid lines indicating cuts between various panels. It will be observed that the blank exhibits mirror symmetry about both its longitudinal axis 12 and its transverse axis 14. Accordingly, a description of less than all of the elements of the blank shown at FIG. 1 will be sufficient to completely describe it.

The numeral 18 denotes a bottom panel defined by the indicated score lines. The numeral 20 denotes either one of two side panels, while numeral 22 denotes either of two top closure panels, the latter connected by the indicated score lines to a respective side panel 20. The numeral 24 denotes a friction locking tab having a reduced neck, with the indicated score or fold or bend line at the base of each friction tab 24 being displaced or spaced from a respective end edge of a respective top closure panel 22.

The numeral 30 denotes a first end panel foldably secured to a respective end of a respective side panel 20. The numeral 32 denotes a stacking tab integral with first end forming panel 30, each tab 32 being located along one of the edges of its respective panel 30.

The numeral 36 denotes either of two second end panels, the outermost portion of each (referred to transverse axis 14) being provided with spaced score lines 38 and 40, to thereby define a distance 39 between them. The numeral 44 denotes a pair of stacking tabs or tongues carried by each one of a respective second end panel 36, tabs 44 being defined by curved cuts 46. It will be observed that tabs 44 span the distance between spaced, parallel score lines 38 and 40.

The numeral 50 denotes a score line joining bottom panel 18 to a respective second end panel 36. The numerals 52 and 54 denote peripheral portions of apertures 53, the latter extending from a respective bottom panel 18 to a respective second end panel 36. The numeral 56 denotes either of the score lines joining a respective first end panel 30 to a respective side panel 20, while numeral 58 denotes a cut line extending at approximately 45 degrees.

The numeral 60 denotes a third end panel, each side of which carries a first post forming panel 62, each of the latter serially connected to a respective post forming panel 64, the latter carrying, serially, a respective fourth end panel 66. The numeral 70 denotes either of two locking tabs carried by a respective third end panel 60, while the numeral 72 denotes any of other locking tabs secured to a free edge of respective fourth end panel 66. Score lines 61 are similar to the other score lines, except that they are slitted as indicated to facilitate their bending more than ninety degrees.

The numeral 68 denotes a tab secured by the indicated score line to a respective second post forming panel 64. As will later be explained, each tab 68 plays no role in the completed box, and is shown as part of the blank 10 because it is used on certain machinery to handle the blank as it is being cut and scored. The presence of tab 68 thus forms no part of this invention.

Figure 2:
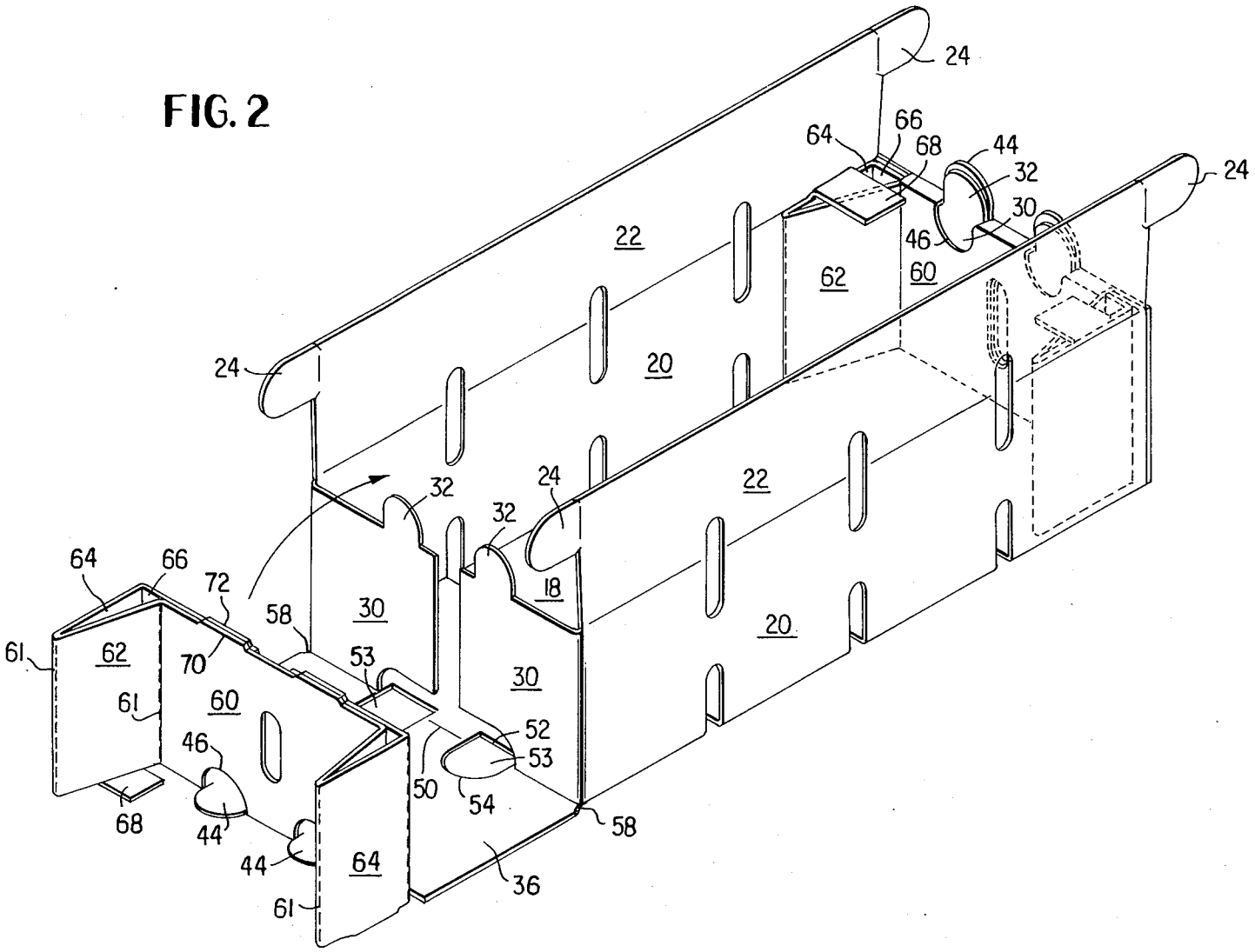
FIG. 2 is a view illustrating a first intermediate stage in the erecting or setting up of the box from the blank shown at FIG. 1.

Referring now to FIG. 2 of the drawings, the blank has been folded about the score lines joining bottom panel 18 to side panels 20, so that the latter are in a vertical position. Also, first end panels 30 have been folded inwardly, while post panels 62 and 64, along with fourth end panel 66, have been folded to the position indicated at FIG. 2. It will be seen that stacking tabs 44 no longer lie in the plane of third end panel 60.

Figure 3:
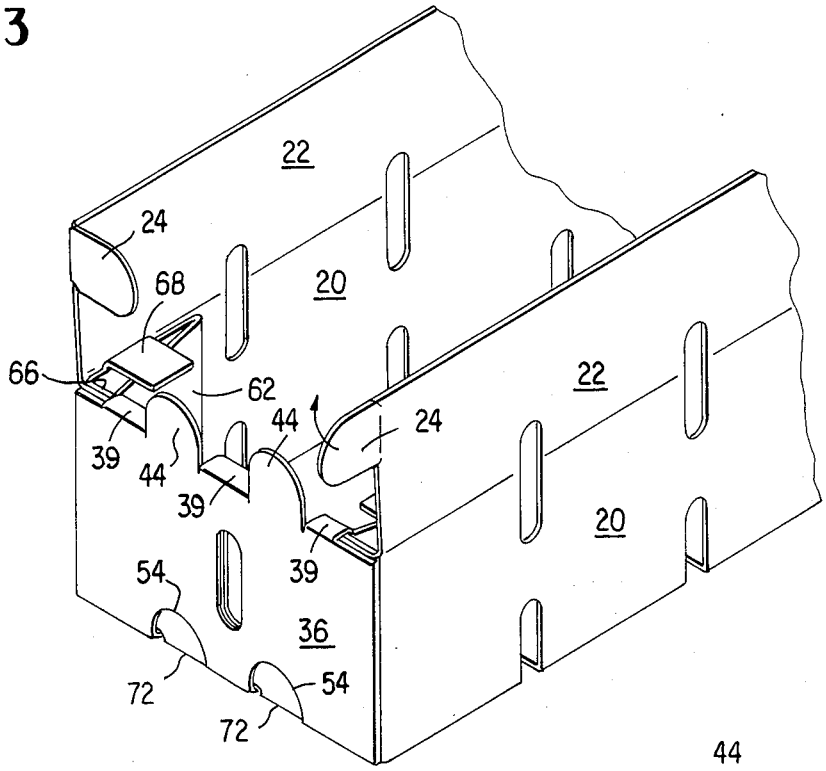
FIG. 3 is a view similar to FIG. 2, and shows a later intermediate stage in the erection of the box from the blank of FIG. 1.

As indicated at the upper right portion of FIG. 2, and also at FIG. 3, the lower left hand elements shown at FIG. 2 are folded so that each second end panel 36 lies flat against a respective first end panel 30, with stacking tabs 32 now extending through the openings in third end panel 60 defined by cuts 46.

As indicated at the upper right portion of FIG. 2, stacking tabs 32 are innermost, while stacking tabs 44 are outermost, with these tabs being arranged in pairs and being in surface contact with each other. Also as shown at this point of FIG. 2, tab 68 lies as indicated, although at this stage, tab 68 may be removed, if desired. As indicated at the upper right portion of FIG. 2 and at FIG. 3, post forming panels 62 and 64 form two sides of triangular posts, with the third side of each such post being formed by a respective part of fourth end panel 66. It will be observed that the vertical extent of post forming panels 62 and 64, together with the indicated part of panel 66, is of an extent equal to the height of vertical dimension of the box, to thereby provide stacking strength at each of the four interior corners of the box.

Figure 4:
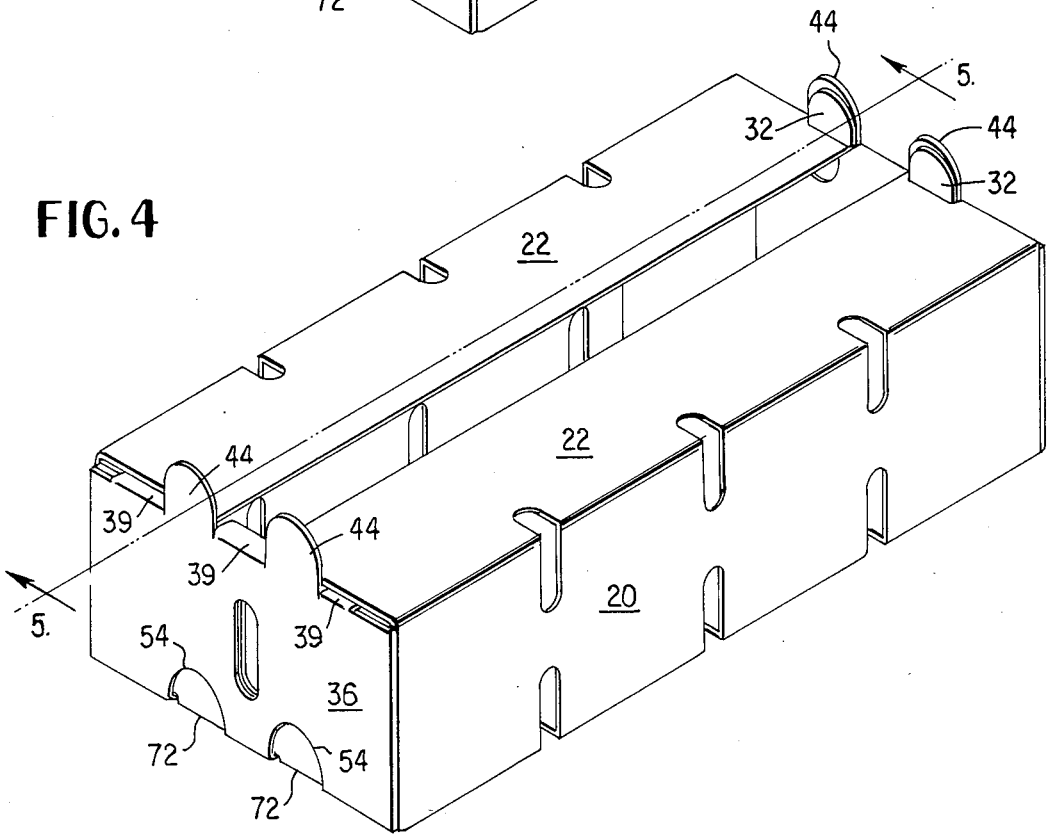
FIG. 4 is a view similar to FIG. 2 and shows the box in its completed or fully erected configuration.
Figure 5:
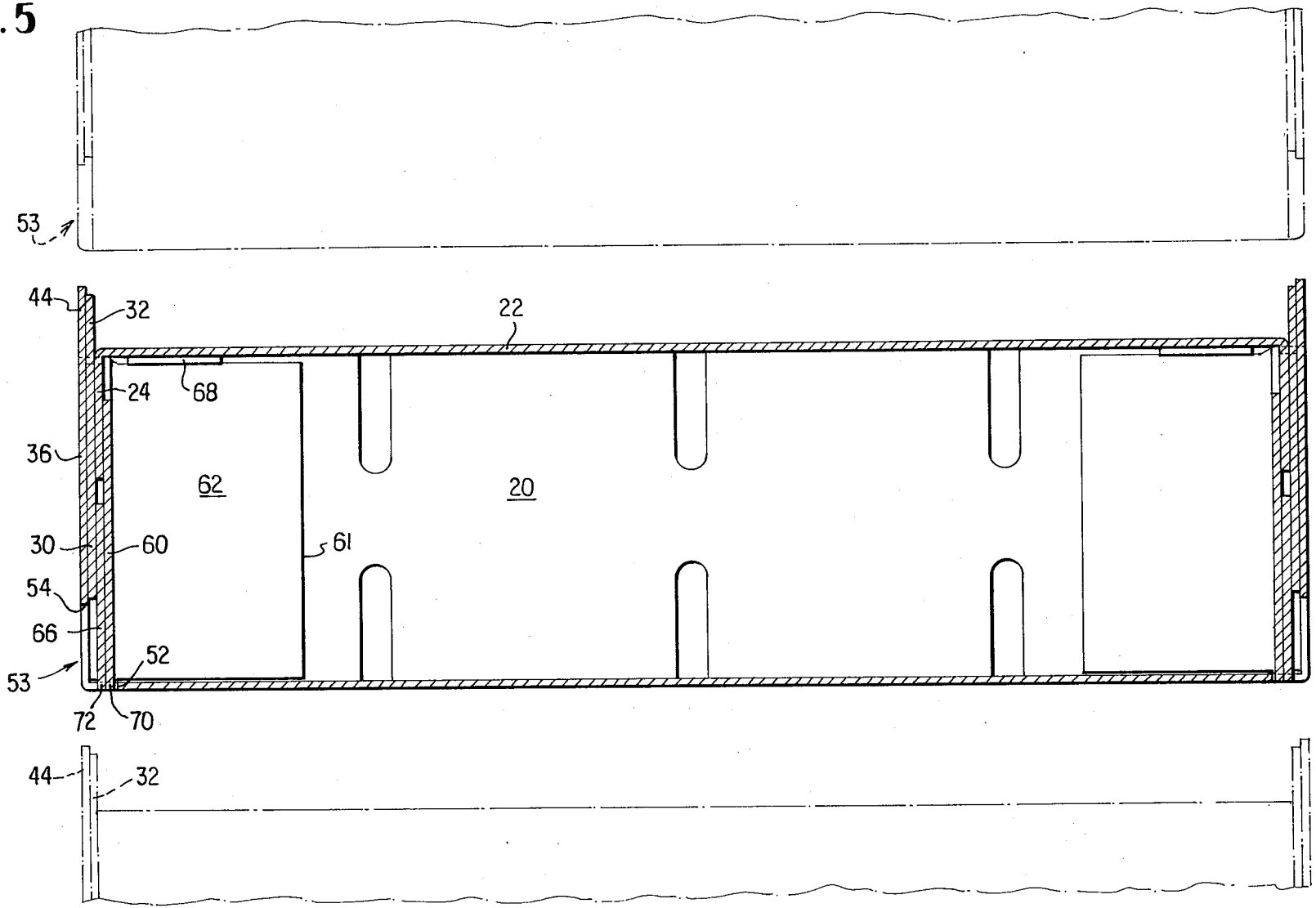
FIG. 5 is a view taken along Section 5—5 of FIG. 4.

Referring again to FIG. 3, the box is now ready for filling with grapes or other articles. After such filling, friction tabs 24 are folded 90 degrees from their configuration, as shown at FIG. 2, as indicated by the left friction tab 24 at FIG. 3. The right tab 24 shown at FIG. 3 is still in the plane of its panel 22 and is to be bent in the direction shown by the curved arrow. Top closure panels 22 are now folded downwardly, with their respective friction flaps 24 entering a space between first end panel 30 and third end panel 60. This space may be seen by the reference to the upper right hand portion of FIG. 2. Referring now to FIG. 5 of the drawings, the friction tabs 44 are again shown, with each lying between a respective first end closure panel 30 and third end closure panel 60. Again referring to FIG. 4, it will be seen that stacking tabs 32 and 34 are arranged pairwise to thereby form four double thickness and upstanding stacking tabs. Tabs 32 are termed innermost stacking tabs, while tabs 44 are termed outermost stacking tabs. As may readily be visualized from FIG. 4, and as clearly shown at FIG. 5, locking tabs 70 and 72 are similarly pair-wise arranged, with each pair fitting into a respective portion of opening 53. This is shown perhaps most clearly at FIG. 5, and it is seen that the distance between peripheral portion 52 of each opening 53 and an imaginary extension of fold line 50 is seen to be equal to three thicknesses of the sheet material, i.e., of the corrugated paperboard. As also clearly shown at FIG. 5, openings 53 assist in defining stacking tab receiving openings, as may be readily visualized by reference to both the solid and the dashed lines at FIG. 5. Again referring to FIGS. 3 and 4, it will be seen that the extent, as measured in a longitudinal direction of the box, or portions 39 is equal to two thicknesses of the corrugated paperboard. Each of the two box end constructions is seen to include four thicknesses of the corrugated material, also adding to the box stacking strength.

The presence of the secondary locking and stacking tabs 32 assists in diminishing the time required for container set up. They lock through the openings defined by cuts 46, these openings developed when panels 60 are bent, releasing the outer tabs 44. This lock action, prior to final box set up, allows the set up person to release hand contact on sides 20, allowing attention to be given to end fold up and final assembly. In addition, without this lock action of tabs 32, sides 20 tend to bulge out when filled prior to locking the top tabs 24. This bulge (prior to the provision of tabs 32) also caused misalignment of tabs 24 when they frictionally engaged tabs 44.

The reduced neck construction which joins friction tabs 24 to their respective top closure panels 22 assists in defining a locking action to thereby assist in maintaining friction tabs 24 in place, i.e., fully received between portions of first end panels 30 and third end panels 60.

It will be observed from a consideration of FIG. 5 that the longitudinal extent of the stacking tab openings 53 in the bottom of the ends of the assembled container is equal to two thicknesses of the corrugated paperboard, i.e., the double thickness of each stacking tab 32, 44.

The numerals which appear in several of the claims are intended to assist the reader, and are not intended as limitations.

What is claimed is:

1. A one-peice blank of stiff, bendable and resilient sheet material, such as corrugated paperboard, said blank being generally rectangular and exhibiting mirror symmetry about both its longitudinal and its transverse axis, said blank having a plurality of cut lines and also having a plurality of score lines about which the sheet material can be bent, to thereby define a plurality of panels each having sides and ends, a bottom panel (18), a side panel (20) secured to each side of said bottom panel by a score line, a top closure panel (22) secured to one side of a respective side panel (20) by a score line, a friction tab (24) carried at each end of each of said top closure panels (22), a first end panel (30) secured to each end of each said side panel (20) by a score line (56), a first stacking tab (32) carried at an edge of said first end panel (30), a second end panel (36) secured to each end of said bottom panel (18) by a score line (50), each of said second end panels (36) carrying a pair of stacking tabs (44), a third end panel (60) connected to a respective said second end panel (36) by a spaced pair of spaced apart, parallel score lines (38, 40), a pair of serially connected post forming panels (62, 64) secured to each side of a respective third end panel (60), said post forming panels (62, 64) and said third end panel (60) being of the same width, a fourth end panel (66) secured to a respective one (64) of said post forming panels, said fourth end panel (66) having a portion thereof which is of the same width as the width of said post forming panel (64) to which it is attached, a pair of stacking tab receiving openings (53) intersecting each score line (50) between saind bottom (18) and second end panels (36), the bottom panel (18) portion of said stacking tab receiving openings (53) having a portion (52) spaced from said score line (50) between said bottom (18) and second end panels (36) a distance equal to three thicknesses of said sheet material, said third panel (60) having a pair of spaced apart locking tabs (70, 70), and wherein each fourth end panel (66) carries a locking tab (72).

2. A one-piece blank of stiff, bendable and resilient sheet material, such as corrugated paperboard, said blank being generally rectangular and exhibiting mirror symmetry about both its longitudinal and its transverse axis, said blank having a plurality of cut lines and also having a plurality of score lines about which the sheet material can be bent, to thereby define a plurality of panels each having sides and ends, a bottom panel (18), a side panel (20) secured to each side of said bottom panel by a score line, a top closure panel (22) secured to one side of a respective side panel (20) by a score line, a friction tab (24) carried at each end of each of said top closure panels (22), a first end panel (30) secured to each end of each said side panel (20) by a score line (56), a first stacking tab (32) carried at an edge of each of said first end panels (30), a second end panel (36) secured to each end of said bottom panel (18) by a score line (50), each of said second end panels (36) carrying a pair of stacking tabs (44), a third end panel (60) connected to a respective said second end panel (36) by a spaced pair of spaced apart, parallel score lines (38, 40), a pair of serially connected post forming panels (62, 64) secured to each side of a respective third end panel (60), a fourth end panel (66) secured to a respective one (64) of said post forming panels, said third panel (60) having a pair of spaced apart locking tabs (70,70), each fourth end panel (66) carrying a locking panel (72) a pair of stacking tab receiving openings (53) intersecting each score line (50) between said bottom (18) and second end panels (36), the bottom panel (18) portion of said stacking tab receiving openings (53) having a portion (52) spaced from said score line (50) between said bottom (18) and second end panels (36) a distance equal to three thicknesses of said sheet material.

3. A box of a geerally rectangular parallelpiped shape formed from a one-piece blank of stiff, resilient and bendable sheet material, such as corrugated paperboard, said box having a bottom panel, two side panels, top closure panels, the latter each secured to a respective side panel, each panel having ends and sides, and an end panel construction for each of the two ends of the box, said end panel construction defined by a first end panel secured to each end of said side panels, a second end panel secured to each end of said bottom panel, a third end panel secured to a respective end of a respective second end panel, serially connected post forming panels at each inside corner of the box and forming two sides of a generally triangular post, a fourth end forming panel connected to a respective one of said triangular post forming panels, two outermost stacking tabs extending upwardly from each of said second end panels, an innermost stacking tab extending upwardly from each of said first end panels, respective pairs of said outermost and said innermost stacking tabs being in surface contact with each other, a friction locking tab at each end of each of said top closure panels each said friction tab being received and frictionally held between said first and third end panels stacking tab receiving openings at the bottom of each of said end panel constructions, said third end panel having a pair of spaced apart locking tabs, each of said fourth end panels having locking tab which is aligned with a respective one of said third end panel locking tabs, each pair of said aligned locking tabs being received in a respective one of said stacking tab receiving openings whereby said box is stackable with other, identical boxes.

* * * * *